US005357653A

United States Patent [19]

van Ardenne

[11] Patent Number: 5,357,653

[45] Date of Patent: Oct. 25, 1994

[54] CLIP FOR PAPER OR OTHER OBJECTS

[75] Inventor: Johanna L. M. van Ardenne Voorschoten, Netherlands

[73] Assignee: Multibridge B.V., Voorschoten, Netherlands

[21] Appl. No.: 922,544

[22] Filed: Jul. 31, 1992

[30] Foreign Application Priority Data

Jul. 31, 1991 [NL] Netherlands ..... 9101313

[51] Int. Cl.[5] ..... B42F 1/02

[52] U.S. Cl. ..... 24/67.9; 24/555; 24/563

[58] Field of Search ..... 24/563, 545, 555, 67.3, 24/67.5, 67.9, 442

[56] References Cited

U.S. PATENT DOCUMENTS

| | | | |
|---|---|---|---|
| 1,070,683 | 8/1913 | Hule | 24/563 |
| 1,476,887 | 12/1923 | Heerey | 24/563 X |
| 1,493,072 | 5/1924 | Fricker | 24/563 |
| 3,294,229 | 12/1966 | McConnell et al. | 24/563 X |
| 4,403,366 | 9/1983 | Lucke | 24/442 X |
| 4,946,065 | 8/1990 | Goulter et al. | 24/563 X |

*Primary Examiner*—James R. Brittain
*Attorney, Agent, or Firm*—Edmund M. Jaskiewicz

[57] ABSTRACT

Clip for holding and/or keeping together sheets of paper or other materials, comprising two holding elements lying essentially in parallel planes and springing relative to each other, and of which the two end edges run parallel at a distance from each other or at an angle relative to each other, and form push-on edges when in use. According to the invention, the two holding elements are in the form of holding legs (1, 2) of sheet-type material, and one (2) of said holding legs is bent in such a way that a part (4, 6) adjacent to the connecting line (3) with the other leg (1) lies at a distance from said other leg, and a second part (8), essentially ending at the push-on edge (13), lies with at least a part of its inside essentially flat and resiliently against the inside of a part (9) of the other holding leg (1). The clip can also be placed on other objects of different types.

5 Claims, 1 Drawing Sheet

CLIP FOR PAPER OR OTHER OBJECTS

BACKGROUND OF THE INVENTION

STATE OF THE ART

The invention relates to a clip for holding and/or keeping together sheets of paper or other materials, or for placing on/against other objects of different types, comprising two holding legs of sheet-type material lying essentially in parallel planes and springing relative to each other, and of which the two end edges cross at an angle relative and form, when in use, with at least part of their lengths, push-on edges, defining a reverse V-shaped push-on space, at least one of said holding legs being bent in such a way that a part adjacent to the connecting line with the other leg lies at a distance from said other leg, and a second part, essentially ending at the push-on edge, lies with at least a part of its inside essentially flat against the inside of a part of the other holding leg.

A clamp of this type is disclosed in U.S. Pat. No. 1,637,564. It has the advantage in being fit for providing information on parts of the plate material, and is also fit to hide for example staples. However, the substantially V-shaped push-on space is formed for the greater part by two points in which the foremost holding leg ends. The rear holding leg is shorter and ends in a single point in the middle of the width. In order to create a push-on facility all these points are curved rearwardly. By this, they are inclined to introduce damages, by scratches or folds, onto the paper or the other material which they hold together, or on which they have been placed, both when placing them and with removing them. Furthermore the parts of the front and rear holding legs, initially lying one against the other, will not remain flat against each other when one or several sheets of paper are inbetween them; the contact is limited to a line contact. As a result the capacity is very much limited and also the risk increases that the rear holding leg is being gripped and thereby pulled off the pile of sheets.

Also a clip for paper is known which comprises two holding elements lying essentially in parallel planes and springing relative to each other, and of which the two end edges run at an angle relative to each other, and form push-on edges when in use, which edges define a V-shaped push-on space. This is a paper clip of spring steel wire (as a variation of the most common type of paper clip with two semi-circular push-on ends lying some distance apart).

A major disadvantage lies in the thickness arising from the diameter of the steel wire from which they are made, and from the fact that the paper will bend through the gripping action. Also the deformation when pushing on is concentrated as torsion of the part of the wire which constitutes the connection between the two holding members; thereby these holding members will not lie anymore parallel to each other and flatly against the paper which is being clamped, but they will stand outwards, so that there will be no flat clamping effect. When a number of piles all containing such paper clips on the same corner, are stacked up, a thickening which is a multiple of the thickness of the whole pile of paper is very soon produced at the corner.

Ordinary and special paper clips are known (WO 81/01535) which can be provided with client-specific identification; they are expensive, however. Besides, they cannot be used together with permanent holders (e.g. staples), or at least they provide no possibilities for masking the common staple.

OBJECTS OF THE INVENTION

The object of the invention is to provide an artistically sound product which is functionally comparable to or better than the known holders, with which all disadvantages indicated above are eliminated, and with which a number of sheets of paper can be combined to one unit, without any of the materials being damaged and the artistic character of the special information being destroyed.

SUMMARY OF THE INVENTION

For this purpose, the clip according to the invention is characterised in that the bending in the at least one holding leg is realised such that the legs lie one against the other under a bias force, in that the two legs, at substantially equal distances from the connecting line, both terminate in a single point and are flat in the proximity of their extreme edges which constitute the push-on edges.

As regards holding, the clip according to the invention combines virtually all positive features of the staple and the paper clip while, in practical terms, all disadvantages of both holders are eliminated as well as those of the other clips discussed above. It provides semi-permanent holding through much greater gripping force than all known paper clips.

The broad, flat holding area between the two holding legs, which, as a result of the bias tension, will remain flat, means that the clips have a greater gripping force than the known paper clip, with the result that when a page is turned they cannot slip as easily from the paper. The basic type clips 1 to about 15 sheets of paper (approximately 80 grammes), the total thickness of the paper held by the clip increasing only by the material thickness, and thus being only negligible, in contrast to conventional paper clips and staples. Unlike all prior art paper clips, the clip also remains virtually always completely flat.

Paper clips making use of twisting techniques almost always have the disadvantage that the ends of the holding legs stand out and thus produce an additional thickening on top of the thickening resulting from the thickness of the material of the paper clip; in the case of the clip according to the invention, the ends of the holding legs cannot stand out. This means already in the case of two pages that the clip is less thick in use than staples and paper clips, with the result that gripped papers are more readily stackable. Through the same property, the clip never—or hardly ever—catches, because it has no parts projecting from the plane.

It can be slipped very readily without tools into the correct position, with a certain natural ease and without hurting the fingers, thus by anyone, but it can also be removed again with the same ease, if necessary temporarily (e.g. for photocopying).

The clip according to the invention is very easy and quick to place in the intended place, without tools (e.g. no stapler), as a result of the V-shape which the two holding legs form with each other. The legs therefore need not be moved apart; for, the material to be joined can simply be turned between the legs and slid in. Once fitted, the clip can be pushed fairly easily into the correct position, owing to the flat clip shape. It is also easy to remove from the gripped material on account of the finger grip, which also results from the design of the clip. Compared with conventional small paper clips, putting it on does not hurt the fingers as much, owing to the flat shape of the holding legs. Unlike the conventional paper clip and the staple, the clip is absolutely not destructive. Damage to writing paper and to the glaze layer of photographs or leaflets etc. and scratches and creases are ruled out.

The clip can be re-used, and its functionality, gripping power and character, even after use for the maximum of material, are fully retained. Finally, its specific shape means that the clip can be pushed over a staple, with the result that it also gives a pleasing appearance to and identifies items which must be kept permanently together. The staple then has to be placed in such a way that it comes to lie inside the region where the clip according to the invention has its bends, because there is space there for the staple between the front holding leg and the top part of the rear holding leg.

In order to obtain absolute fixing of the clip, and thus actually in order to prevent easy removal, it is also possible to make one or more inward directed V-shaped incisions in the rear side of the clip, which on attempts at shifting will cut into the gripped material. This therefore does not involve any additional action during placing on the object. Removal without damage is then possible only by using a special tool, where, for example, a hard strip is slid into the clip, or the holding legs are bent apart (use for clothing). There is therefore no problem during the placing. One or more of said V-cuts can already be made at the time of manufacture, and not directed inward until later (with special tool).

The clip according to the invention is already very attractive in its basic form, but its design is neutral. It can be adapted to convey the message of any target group through the direct application of plain or coloured messages, logos, trade marks etc. In addition to its function as a paper clip, the invention can be used—possibly in a different size or shape, but on the basis of the same powerful holding construction combined with ease of placing (V-shape)—as a money clip, tie pin, garment ornament, hanging clip (with wire or provided with adhesive strip or eyelet), badge, tab, clothes peg, bookmark or identification clip through different colours, photograph hanging or poster hanging clip, or as a memo clip by means of which smaller notes or memos can be attached to a larger sheet or other surface, by applying double-sided permanent or semi-permanent adhesive strip or something similar to the rear side.

Moreover, the clip according to the invention can be provided with all kinds of information and other means of identification on one or both holding legs, by die-cutting or sticking printed or die-cut materials on it. The great advantage of die-cutting or stamping is that it can be carried out during production, with the result that clips with standard texts in large numbers become very cheap.

The clip can also be used purely as a new fastening technique for the same or different materials, which are connected in different forms to or by the clip, e.g. fastening method for brochures etc.

It is conceivable to make the clip in two variants which are a mirror image of each other as regards front view, with the result that a fold line can always be formed by folding over the leg around a push-on edge instead of around the angular transition between a push-on edge and the side edge of the clip.

The clip is preferably made of rustproof or rustproofed sheet metal material of low thickness, e.g. 0.2 mm.

For the manufacture, all kinds of solutions are available to the person skilled in the art of metalworking, in particular punching, moulding and cutting techniques using dies. Modern techniques such as laser cutting or etching techniques can also be used, in particular with a view to the good finish which is then obtainable, in order to rule out damage of the gripped material. The cutting of letters of certain shapes in the faces suitable for them is then carried out, of course, during the manufacture, and the same then also applies to the combination of printing or sticking processes and the shaping techniques.

The invention will be explained below with reference to the appended drawing of an example of an embodiment.

SHORT DESCRIPTION OF THE DRAWING

DESCRIPTION

Figure 1:
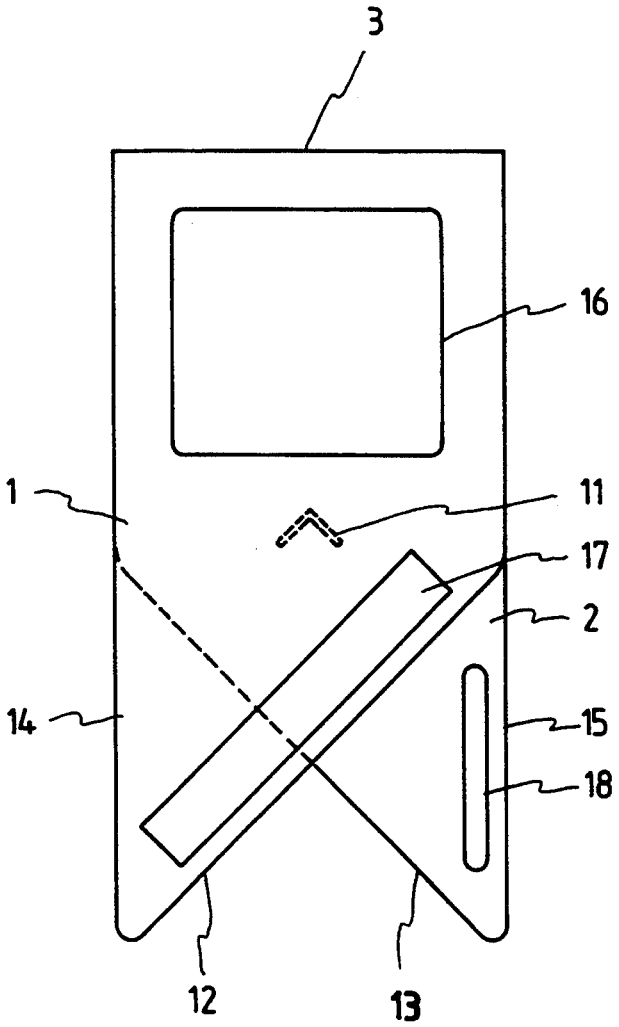
FIG. 1 shows a front view of a clip.

The clip is composed of a front holding leg 1 and a rear holding leg 2, connected to each other at the place indicated by 3.

In the embodiment shown, the connection at the place 3 is in the form of a line where the two legs have been folded during manufacture (a weld at the point 3 between the front and rear leg is also conceivable). The top part 4 of the rear leg 2 forms a small angle $\alpha$ here with the top part 10 of the front leg 1.

At the place indicated by 5, some distance below the fold line or connecting line 3, the rear leg 2 is folded again, towards the front leg 1, so that the said part 4 and the part 6 at the other side of the fold line 5 form an obtuse angle $\beta$ with each other. Since $\beta$ is made smaller than the complement of $\alpha$ (thus the sum of $\alpha$ and $\beta$ is e.g. 5° to 10° less than 180°), the rear leg 2 then comes to rest against the front leg 1, approximately from the point indicated by 7. As a result of the resilience of the materials, the part 8 comes to rest against the lower part 9 of the front leg 1 with a certain force which is used as the gripping force.

The force between the parts 8 and 9 of the rear and front leg respectively also means, of course, that the top part 10 of the front leg does not retain its original flat state, but will bend slightly forward, while the part 6 of the rear leg between the point 7 and the fold line 5 will also bend. The top part 4 of the rear leg will also have a slight curve, but this has not been shown, because that curve will be very small, as a result of the relatively short distance between the lines 3 and 5.

The pressure between the parts 8 and 9 of the rear and front leg respectively takes place over the whole surface where these parts touch each other, from line 7 downwards, because there are in fact no forces giving rise to curvature of these lower parts of the legs.

When the clip made in this way is slid onto one or more sheets of paper or onto another object, the gripping action thus takes place over that entire surface. When, through sliding the clip onto one or more sheets of paper or onto another object, the lower parts 8 and 9 of the clip legs give way slightly, they will always do this parallel; even in this position there is no force which will cause these parts to bend by themselves, unless overloading takes place due to the fact that the fixed clip causes a pile of papers to acquire a greater thickness than the distance between the fold line 5 and the top part 10 of the front leg 1. Up to that limit value the parts 9 and 10 of the front leg and the parts 8 and 6 of the rear leg retain their flat shape when unloaded, and this is also the situation which they again try to reach when the clip is pushed on. (The bending of part 10 could also be reduced if desired by providing some type of recess, rib or similar reinforcement in the sheet material).

The best values of $\alpha$ and $\beta$ which can be used depend on the choice of material to be used. As the elasticity increases, the sum of $\alpha$ and $\beta$ will have to go further away from 180° for the same gripping action. On the other hand, materials with little elasticity will require a greater angle $\alpha$, otherwise the gripping force will become too great, or the capacity too small. For materials which can be used in practice, an angle $\alpha$ of approximately 15° seems preferable, and an angle $\beta$ of 145° to 160°, so that the sum of $\alpha$ and $\beta$ becomes 160° to 175° thus 5° to 20° less than 180°.

Figure 2:
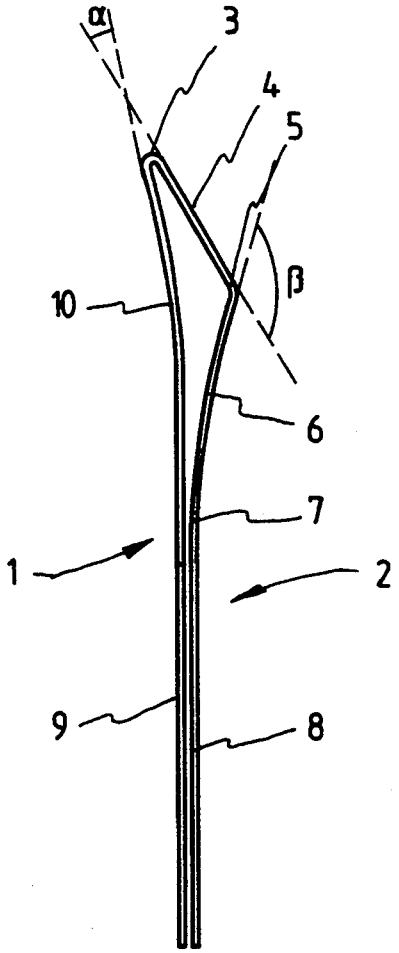
FIG. 2 shows a side view from the right side, for the sake clarity the dimensions in the horizontal direction being shown exaggerated compared with those in the vertical direction.

The basic idea of the invention is to provide such a bend in the rear leg 2 relative to the front leg 1 that flat contact between the parts 9 and 8 can be achieved. For this, solutions other than the fairly sharp fold line 3 and the fold line 5 shown are possible. Instead of the single fold line 5, two fold lines can be made, with the angle transitions being divided. One may even apply a fold region with a relatively great radius of curvature in order to produce the change of direction of part 4 to part 7, by which the clamping force between parts 8 and 9 is obtained. Even if it is made as sharp as possible, the fold line 3 by the nature of things already has a small radius of curvature. This fold need not, however, be made as sharp as possible; the radius of curvature of the bend can be increased, with the result that a smaller angle is produced between the parts 4 and 10. It is also conceivable to replace the single fold line 3 by two fold lines, so that the parts 4 and 10 run essentially parallel to a connecting strip which is horizontal in the drawing. This in particular can increase the capacity of the clip. It is also conceivable, instead of two angular fold lines at the top side, to make a single semi-circular transition zone between essentially parallel parts 4 and 10. This can even go so far that this curve is continued until the zone corresponding to the part 6 in FIG. 2 extends approximately in the same direction; the intended gripping effect is then obtained without further ado.

In the embodiment described so far, the clip can be slid on and off without restriction. It is conceivable to create a fixing by making a V-shaped cut-out in one of the holding legs, shown by dashed lines in FIG. 1 and indicated by 11, which is then bent during manufacture or after placing on the object, so that it resists removal and shifting.

In the embodiment shown, the push-on edges 12 and 13 of the front and rear leg respectively, by means of which—as the name already indicates—the clip is inserted on the edge of the sheets of paper or the other object, following which it is slid over it, are at an angle of 45° relative to the long edges 14, 15 respectively, so that they are at right angles to each other. Other angles are also conceivable. For purposes of this pushing on, it is desirable for the edges 12 and 13 to be rounded at least at the sides of the legs 1 and 2 facing each other. They must, of course, at least be made free from burrs, but these are aspects connected with the manufacturing method, and they are problems which will be solved by the person skilled in the art.

The front and the rear holding leg are also shown to be the same shape. Here again, this is not essential. Instead of the trapezoidal shape shown, all kinds of shapes are conceivable, in which the long legs and the push-on edges run at other angles or are curved, or meander, provided that the push-on edges cross each other at one or two points, in order to make it easy to start the pushing on, while the front and the rear holding leg can also be different shapes from each other. The only important factor is that a sufficiently large contact face should remain for achieving the gripping effect according to the invention.

It is also advantageous to make an embodiment which in front view is the mirror image of that of FIG. 1. When the embodiment of FIG. 1 is pushed onto the top edge of a pile of sheets near the left corner, a fold line around edge 12 is automatically obtained on turning over. If the clip is pushed on along the left side, e.g. especially in order to cover a staple inserted parallel to that left edge, one has to fold round one point, which could cause tilting of the clip, with the risk of it cutting into the paper, and the paper can be more easily pulled out of the clip. This is prevented by a mirror image embodiment, for we then again have a fold line running at 45° relative to the top edge and left edge.

It will be clear that the holding legs of the clip according to the invention have all kinds of surfaces on which information can be placed, either by printing, or by stamping or cutting out. This is indicated by way of example by information faces 16 and 17 at the front side of the front leg, but also by a face 18 which is situated on the visible side, but is in fact on the inside of the rear leg 2. The invention is not, however, restricted to the places to which this information is applied, and it is, of course, equally not restricted to the way in which said information is placed on the clip. A further variant of this is the provision of holes of a certain shape. If these holes are too large, the gripping force could be reduced at the position of the contact faces 8 and 9, but in particular at the position of the face 16 shown, thus in the top part 10 of the front holding leg, holes of different shapes can be cut out, or can be made by, for example, laser cutting, without reduction of the gripping surface. It must be remembered here that too extensive removal of material could result in a reduction of the gripping force of the whole product.

Printing with ink which can be written on, or printing with a bar code are particularly advantageous.

The clip can be designed in such a way that it is provided with a hanging device in the form of a cord or wire loop threaded through the space present in the top part of the clip, or with a stamped-out hanging eyelet near the fold line 5 in holding leg 2. It is also advantageous if a number of clips are fixed permanently or by adhesive on an elongated carrier. The clip can also be provided with a layer of adhesive on the rear side 2, either for permanent fixing or for temporary fixing.

What is claimed is:

1. A clip for retaining together sheets of paper or other materials comprising a single thin strip of resilient sheet-like material bent upon itself to define an end fold (3) and first and second holding legs; said first holding leg having a first upper end and the second holding leg having a second upper end respectively interconnected at said end fold, said first upper end defining a small angle $\alpha$ with said second upper end; said first leg having a bend (5) spaced from said end fold so as to define said first upper end therebetween; said first leg further having a central portion (6) adjoining said bend and said central portion defining an obtuse angle $\beta$ with said first upper end at said bend such that said first upper end, said bend and said central portion are spaced from said second holding leg; said first leg having a lower portion (8) extending from said central portion and biased flatly against said second leg, to exert a force thereon such that at least the second upper end of said second leg curves away from the first upper end of said first leg; said first and second holding legs each having first and second lower ends respectively opposite said end fold and said lower ends intersecting at an angle with respect to each other so as to define a reverse V-shaped push-on space; said first and second lower ends each terminating in a single rounded point.

2. A clip as claimed in claim 1 wherein said bend comprises a fold line.

3. A clip as claimed in claim 1 wherein the length of said first upper end between said end fold and said bend is less than one fourth of the distance from said end fold to the intersection of said first and second lower ends.

4. A clip as claimed in claim 1 wherein said angle $\alpha$ is substantially 15 degrees and said angle $\beta$ is in the range of 145–160 degrees.

5. A clip as claimed in claim 1 wherein said first and second lower ends intersect at substantially a right angle.

* * * * *